US007748359B2

(12) United States Patent
Bartley et al.

(10) Patent No.: US 7,748,359 B2
(45) Date of Patent: Jul. 6, 2010

(54) TAPPET ASSEMBLY

(75) Inventors: Bradley E. Bartley, Pekin, IL (US); Alan R. Stockner, Metamora, IL (US); David C. Mack, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 338 days.

(21) Appl. No.: 11/819,645

(22) Filed: Jun. 28, 2007

(65) Prior Publication Data

US 2008/0006233 A1 Jan. 10, 2008

Related U.S. Application Data

(60) Provisional application No. 60/817,391, filed on Jun. 30, 2006.

(51) Int. Cl.
*F01L 1/14* (2006.01)

(52) U.S. Cl. ..... 123/90.48; 123/90.52

(58) Field of Classification Search ..... 123/90.48, 123/90.51, 90.52
See application file for complete search history.

(56) References Cited

U.S. PATENT DOCUMENTS

| | | | | |
|---|---|---|---|---|
| 2,372,694 | A | 4/1945 | Tabb | |
| 2,735,313 | A | 2/1956 | Dickson | |
| 4,361,120 | A | 11/1982 | Kueny | |
| 4,708,102 | A | 11/1987 | Schmid | |
| 4,768,476 | A | 9/1988 | Behnke et al. | |
| 4,793,295 | A | 12/1988 | Downing | |
| 4,909,197 | A | 3/1990 | Perr | |
| 4,967,705 | A | 11/1990 | Maciag et al. | |
| 5,099,807 | A | 3/1992 | Devine | |
| 5,398,648 | A | 3/1995 | Spath et al. | |
| 5,545,013 | A * | 8/1996 | Beck et al. | 417/201 |
| 5,797,364 | A | 8/1998 | Meek et al. | |
| 6,056,442 | A | 5/2000 | Ono et al. | |
| 6,213,075 | B1 | 4/2001 | Ajayi et al. | |
| 6,220,758 | B1 | 4/2001 | Ono et al. | |
| 6,345,597 | B1 | 2/2002 | Keeler | |
| 2001/0035516 | A1 * | 11/2001 | Nichols et al. | 251/368 |
| 2002/0109368 | A1 * | 8/2002 | Mink et al. | 296/26.13 |
| 2006/0105171 | A1 | 5/2006 | LaBarge et al. | |

FOREIGN PATENT DOCUMENTS

| | | |
|---|---|---|
| DE | 1 776 119 | 10/1971 |
| GB | 944894 | 12/1963 |
| GB | 2281601 | 3/1995 |

* cited by examiner

*Primary Examiner*—Zelalem Eshete
(74) *Attorney, Agent, or Firm*—Finnegan, Henderson, Farabow, Garrett & Dunner

(57) ABSTRACT

In one aspect, the present disclosure is directed to a tappet assembly for a machine. The assembly may include a tappet body, a pin fixedly mounted in the tappet body, and a substantially cylindrical roller mounted about the pin. The roller may have a substantially cylindrical outer surface with a circumferential dimension and a width dimension, the width dimension being defined by two lateral edges. The roller may be configured to provide rolling contact between the outer surface of the roller and a cam lobe. The outer surface of the roller may be crowned such that at maximum operational loading conditions of the machine a footprint of contact pressure from the cam lobe is spread substantially the full width of outer cylindrical surface of the roller.

20 Claims, 6 Drawing Sheets

TAPPET ASSEMBLY

PRIORITY

The present application claims the benefit of priority under 35 U.S.C. §119(e) to U.S. provisional patent application No. 60/817,391, filed Jun. 30, 2006.

TECHNICAL FIELD

The present disclosure is directed to a tappet assembly and, more particularly, to a tappet assembly having features for reducing stress and friction.

BACKGROUND

Fuel systems for engines may include pumping devices configured to pressurize the fuel prior to injection into the combustion chambers of the engine. For example, in common rail fuel systems, a tappet assembly may be configured to drive a plunger and/or piston, which may be configured to pressurize the fuel. The tappet assembly may include a tappet having a pin attached to the tappet and a roller mounted about the pin, and configured to rotate around it. The roller may be configured to contact a cam lobe, which drives the tappet up and down.

For heavy duty applications, the loads on such tappet assemblies may be significant, which can cause failure of one or more components of the assembly if the assembly is not constructed robustly enough. In some cases, the effect that certain loads have on the assembly can be amplified by stress concentrations. For example, in some assemblies, stresses can become concentrated at the ends of the roller. Areas of stress concentrations can act as the weakest link in an otherwise robust assembly, leading to seizing and/or cracking of rollers.

Some assemblies have been developed that attempt to reduce stresses. For example, U.S. Pat. No. 2,735,313, issued to Dickson ("the '313 patent"), discloses a roller having a crowned inner surface and a crowned outer surface. The crowned inner surface allows for a more even load distribution on the inner surface of the roller and/or the outer surface of the pin. The crown is designed to mate better with the pin under loading. Under loading, the pin bends, conforming the pin with the crown of the inner surface of the roller.

The outer surface of the roller is crowned in such a way as to roll on a similarly but oppositely crowned camshaft follower lifting surface, allowing for unrestrained rolling engagement during cocking of the roller about its shaft 20. In other words, because of the crowned inner surface of the roller, under light loads when the pin does not bend, the roller may tilt back and forth relative to the pin. In order to maintain suitable rolling contact with the tilted roller, the outer surface of the roller and the camshaft follower lifting surface have been crowned to facilitate rolling engagement.

In addition, poor frictional properties of mating components may also lead to failure, particularly during engine start-up when lubrication oil may not have been circulated yet. Surfaces of the tappet assembly must not only possess significant strength, but also must have low frictional properties. Some assemblies have provided coatings, such as tungsten carbide carbon (WCC), on various surfaces of the assembly to create a low friction, durable surface on top of a high strength material, such as steel. However, none of these assemblies have utilized a coating such as WCC on the outer surface of the roller.

While the device disclosed in the '313 patent may disclose a configuration designed to reduce stresses between the pin and roller, the interface between the roller and camshaft follower lifting surface is not configured such that a footprint of contact pressure from the camshaft follower lifting surface, at maximum operational loading conditions of the machine, is spread substantially the full width of the outer surface of the roller. Therefore, in the device of the '313 patent, the contact patch between the roller and the camshaft follower lifting surface is relatively narrow, even at high loads. Concentration of high loads in such a narrow contact patch results in high stresses that may render the roller susceptible to failure.

The present disclosure is directed at improvements in existing tappet assemblies.

SUMMARY OF THE INVENTION

In one aspect, the present disclosure is directed to a tappet assembly for a machine. The assembly may include a tappet body, a pin fixedly mounted in the tappet body, and a substantially cylindrical roller mounted about the pin. The roller may have a substantially cylindrical outer surface with a circumferential dimension and a width dimension, the width dimension being defined by two lateral edges. The roller may be configured to provide rolling contact between the outer surface of the roller and a cam lobe. The outer surface of the roller may be crowned such that at maximum operational loading conditions of the machine a footprint of contact pressure from the cam lobe is spread substantially the full width of outer surface of the roller.

In another aspect, the present disclosure is directed to a tappet assembly, including a tappet body, a pin fixedly mounted in the tappet body, and a substantially cylindrical roller mounted about the pin. The roller may be configured to provide rolling contact with a cam lobe and may include two end surfaces defining a maximum axial length of the roller. At least one surface of the tappet body or the roller may be coated with a tungsten carbide and carbon coating.

In another aspect, the present disclosure is directed to a tappet assembly, including a tappet body, a pin fixedly mounted in the tappet body, and a substantially cylindrical roller mounted about the pin. The roller may have a substantially cylindrical outer surface and two end surfaces defining a maximum axial length of the roller. In addition, the roller may be configured to provide rolling contact between the outer surface of the roller and a cam lobe. Further, the outer surface of the roller may include a tungsten carbide and carbon coating.

DETAILED DESCRIPTION

Reference will now be made in detail to the drawings. Wherever possible, the same reference numbers will be used throughout the drawings to refer to the same or like parts.

Figure 1:
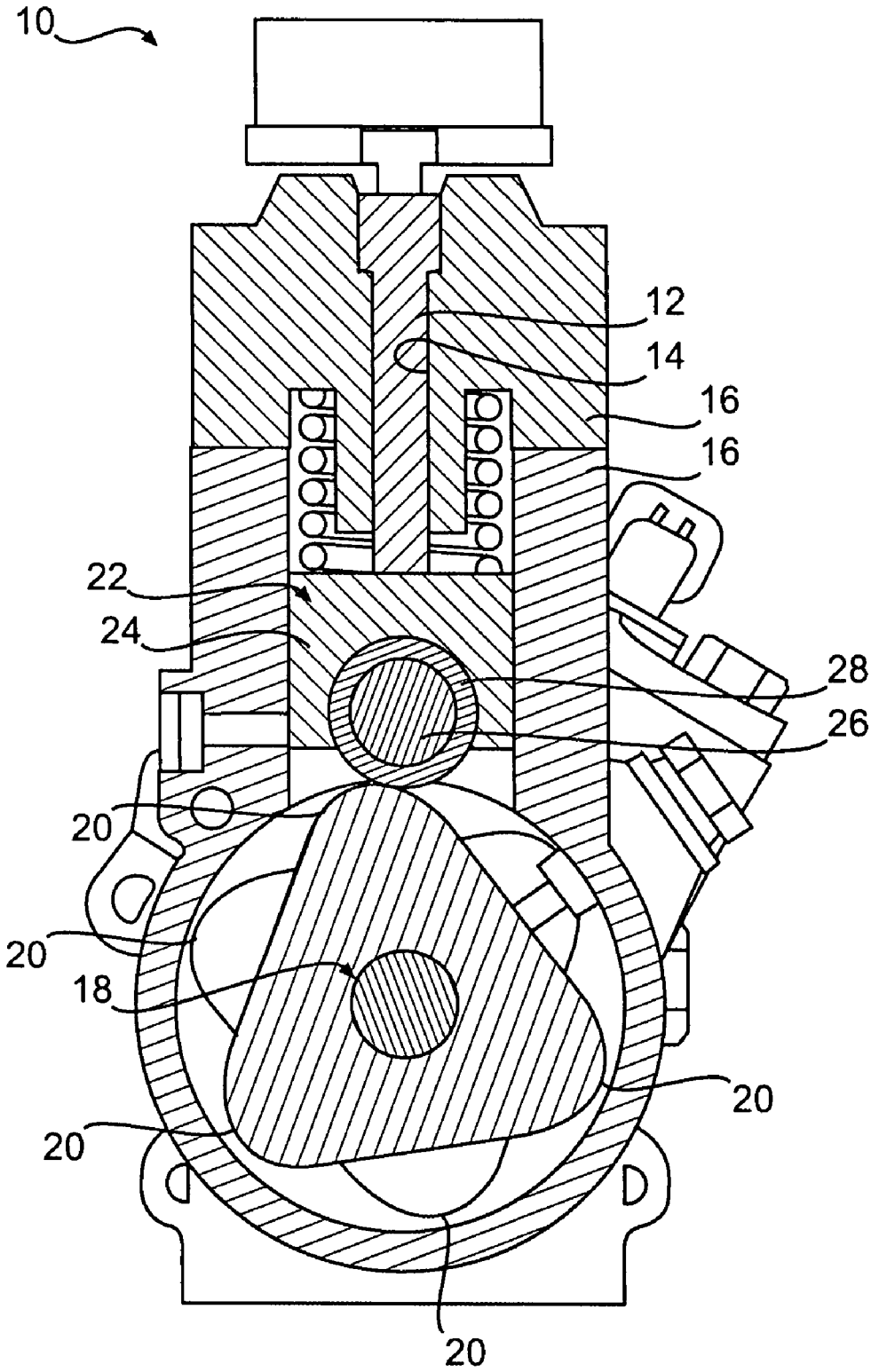
FIG. 1 is a diagrammatic cross-section of a fuel pump according to an exemplary disclosed embodiment.

FIG. 1 shows an exemplary common rail fuel pump 10, which may include a plunger 12 configured to slide within a cylindrical bore 14 of a housing 16 in order to pressurize fuel in the common rail system. Plunger 12 may be driven by a cam 18 having at least one cam lobe 20 configured to drive a tappet assembly 22 operatively connected to plunger 12. Tappet assembly 22 may include a tappet body 24 and a cylindrical pin 26 fixedly mounted in tappet body 24. Tappet assembly 22 may also include a substantially cylindrical roller 28 mounted about pin 26 and configured to provide rolling contact with cam lobe 20. Although shown in a common rail fuel pump application, tappet assembly 22 may be used for any application of a tappet, as discussed in greater detail below.

In some embodiments, pin 26 may be fixed within tappet body 24 by an interference fit. In some embodiments, the interference fit may be accomplished by inserting pin 26 into tappet body 24 in a cooled state. For example, pin 26 may be cooled and inserted into tappet body 24. As pin 26 warms up, it expands to provide a tight fit within tappet body 24. Other means of fixation are also possible, including welding, press fit, or any other type of fixation that securely fixes pin 26 within tappet body 24, thus preventing motion relative to tappet body 24 in any axial or rotational manner, along substantially the entire length of pin 26.

Figure 2:
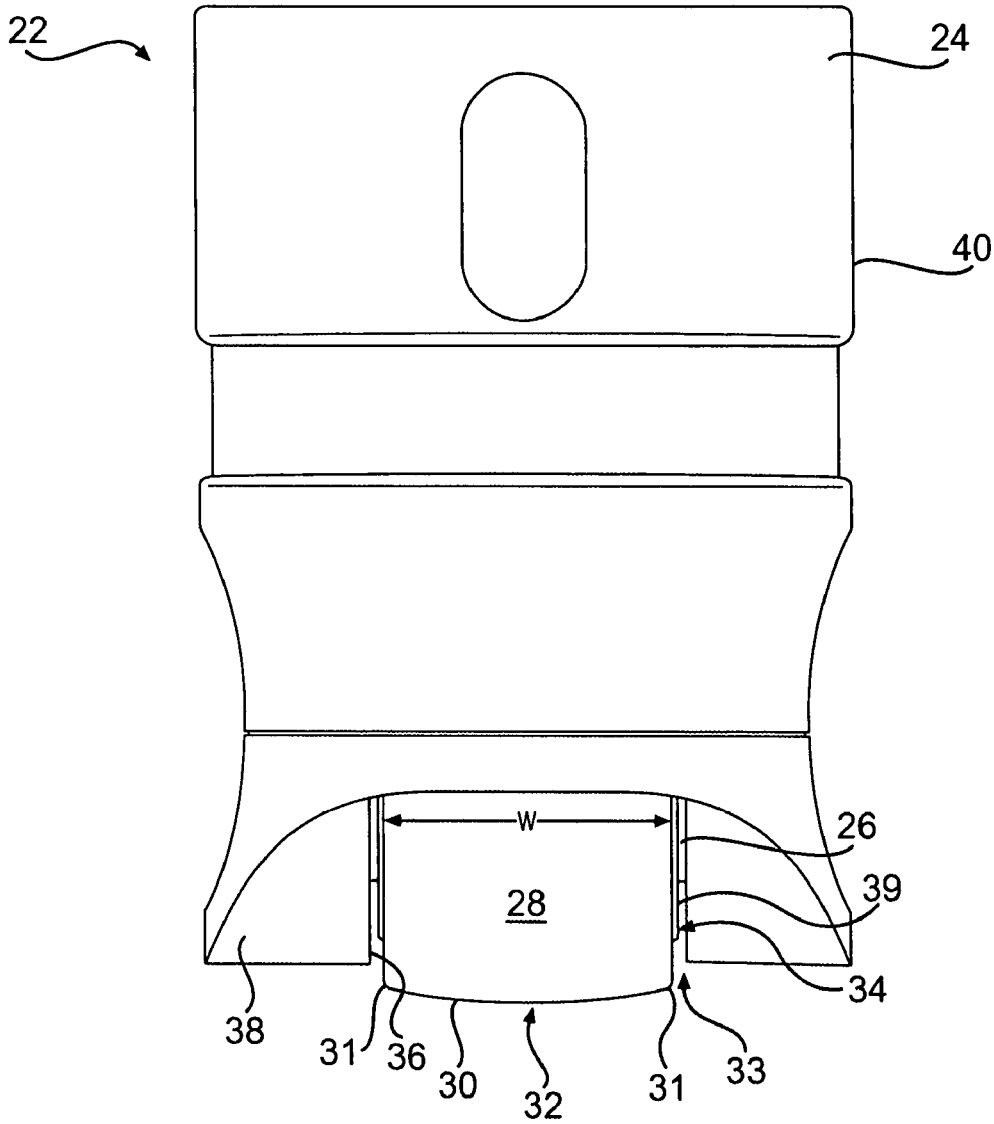
FIG. 2 is a diagrammatic illustration of a tappet assembly according to an exemplary disclosed embodiment.
Figure 3:
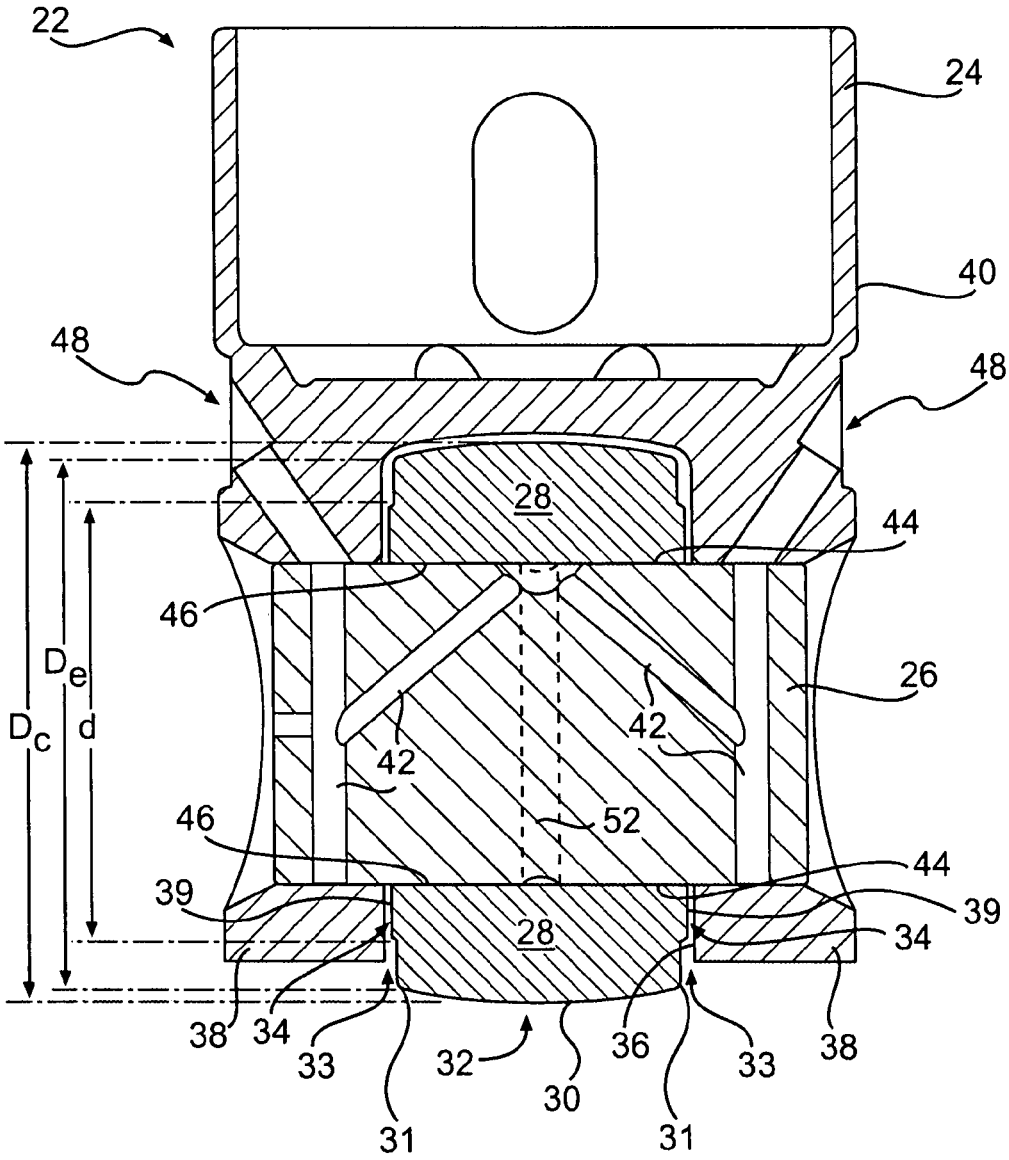
FIG. 3 is a diagrammatic cross-section of the tappet assembly in FIG. 2.
Figure 4:
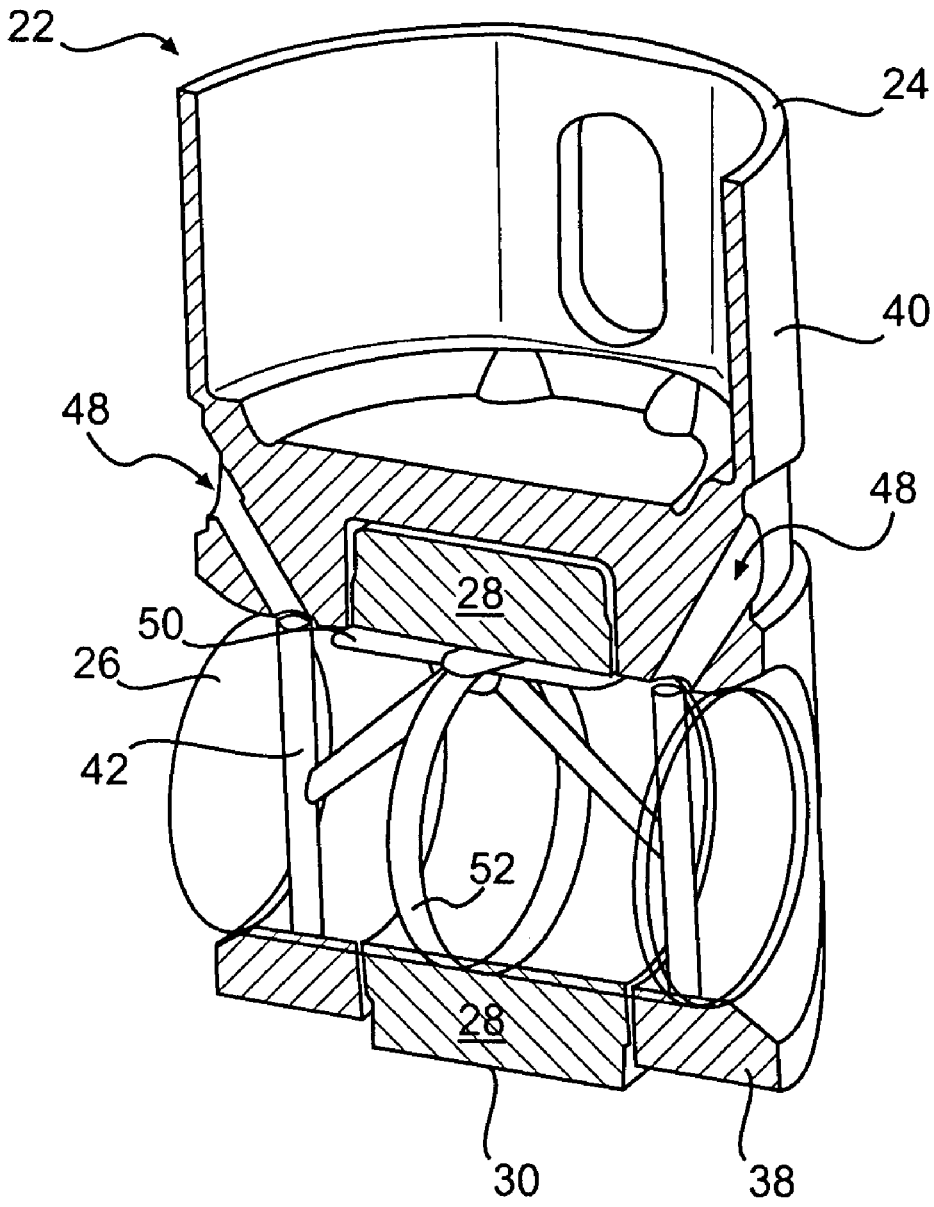
FIG. 4 is a diagrammatic perspective cross-sectional view of the tappet assembly in FIG. 2.

FIGS. 2-4 illustrate an exemplary tappet assembly 22. In some embodiments, an outer surface 30 of roller 28 may be crowned as illustrated in FIGS. 2 and 3. It should be noted that the crown shown in FIGS. 2 and 3 is somewhat exaggerated for purposes of explanation. The actual crown may be comparatively subtle. Outer surface 30 may be substantially cylindrical and may have two lateral edges 31, a central portion 32 substantially equidistant from each of lateral edges 31, and a circumferential dimension (not labeled). As shown in FIG. 2, outer surface 30 may have a width dimension W defined by lateral edges 31. Roller 28 may be configured to provide rolling contact between outer surface 30 of roller 28 and cam lobe 20. Outer surface 30 of roller 28 may be crowned such that at maximum operational loading conditions of pump 10 the footprint of contact pressure from cam lobe 20 is spread substantially the full width W of outer surface 30.

In one exemplary embodiment, width dimension W of outer surface 30 of roller 28 may be approximately 27 mm. In such an embodiment, the crown may be about 0.05 mm at its maximum nominal height, providing roller 28 with a diameter $D_c$ at central portion 32 that is approximately 0.1 mm larger than a diameter $D_e$ at lateral edges 31 (see FIG. 3).

In some embodiments, pin 26 may be made from a material having properties optimized for use in tappet assembly 22. For example, the pin material should be hard enough to resist wear and failure, but soft enough to allow debris to embed in the surface of pin 26. The pin material should also possess low frictional properties in order to allow roller 28 to spin freely on pin 26, particularly during start-up of pump 10, when little or no lubrication may be provided between components of tappet assembly 22. Exemplary materials having such properties may include bronze alloys. In some embodiments, pin 26 may be made at least partially from such a bronze alloy. Suitable alloys may have a composition including about 1.5-4.5% (by weight) zinc, about 3.5-4.5% lead, about 3.5-4.5% tin, about 0.01-0.50 phosphorus, about 0.10% max iron, and the remainder may be copper. In such a material, the sum of copper, tin, lead, zinc, and phosphorus may be at least about 99.5% of the total composition of the alloy. Exemplary materials having such suitable properties and/or composition may include, or may be similar to, SAE 791, SAE CA544, or ASTM B139 Alloy 544.

In some embodiments, roller 28 may have a hub portion 33, having ends 34 with a reduced diameter d as compared to outer surface 30 of roller 28, which may have a larger diameter $D_e$ at lateral edges 31, as shown in FIG. 3. Such reduced diameter hub portions 33 (i.e., at either end of roller 28) may reduce the lateral loading exerted by roller 28 on inner surfaces 36 of tappet ears 38.

In some embodiments, at least one surface of tappet body 24 and/or roller 28 may be coated with a tungsten carbide and carbon (WCC) coating. Such a coating may be a sputtered coating, and may provide reduced friction, particularly in severe loading and/or low lubrication conditions, including, for example, start-up and/or break-in. Exemplary surfaces that may be coated with the WCC coating may include inner surfaces 36 of tappet ears 38, outer surface 30 of roller 28, end surfaces 39 of roller 28, and/or an outer surface 40 of tappet body 24.

In addition, as shown in FIG. 3, lubrication channels 42 may be provided within pin 26, which may distribute lubrication oil between an outer surface 44 of pin 26 and an inner surface 46 of roller 28. Access to lubrication channels 42 may be provided via one or more access channels 48 in tappet body 24. Although pin 26 is shown as being accessible by two access channels 48, embodiments with only a single access channel are also contemplated, as well as embodiments with more than two access channels 48. The configuration of lubrication channels 42 may vary accordingly depending upon how the configuration of access channels 48 are provided in tappet body 24.

Figure 5A:
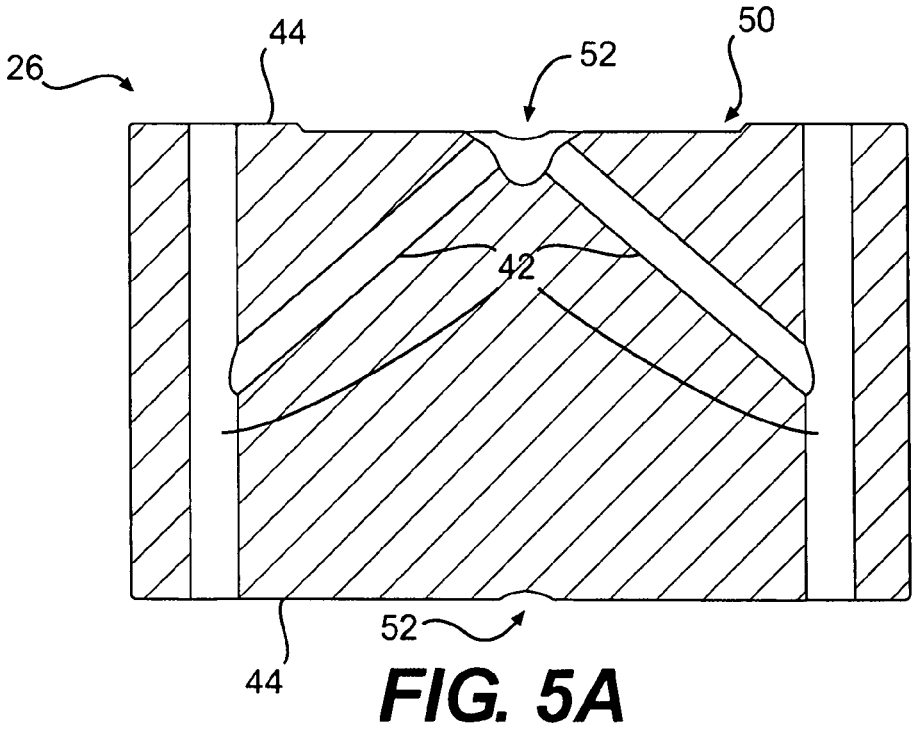
FIG. 5A is a diagrammatic cross-section of a pin from the tappet assembly in FIG. 2.
Figure 5B:
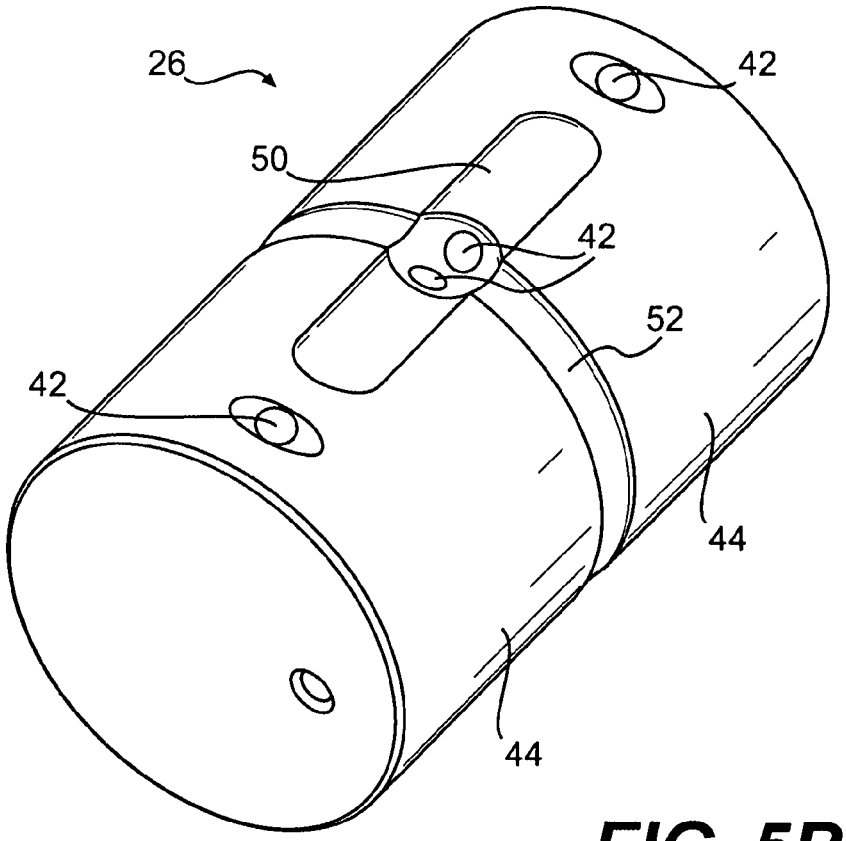
FIG. 5B is a diagrammatic perspective view of a pin from the tappet assembly in FIG. 2.

In order to further enhance such distribution of lubrication oil, e.g., in engine applications of tappet assembly 22, outer surface 44 of pin 26 may include a longitudinal channel 50, which extends longitudinally along outer surface 44 and/or a circumferential channel 52 extending about the circumference of pin 26, as shown in FIGS. 4, 5A, and 5B. Longitudinal channel 50 and/or circumferential channel 52 may be configured to define a reservoir configured to retain residual lubrication oil after oil flow though pin 26 has stopped, e.g., when the engine is shut off. This residual lubrication oil may provide lubrication in situations where circulation of lubrication oil or oil pressure may be low, such as, for example, on engine startup, i.e., during cranking and/or engine acceleration from starting before lubrication oil has reached full circulation. In particular, longitudinal channel 50 and/or a circumferential channel 52 can be sized and/or shaped to provide a reservoir of oil that provides lubrication during starting conditions.

Figure 6:
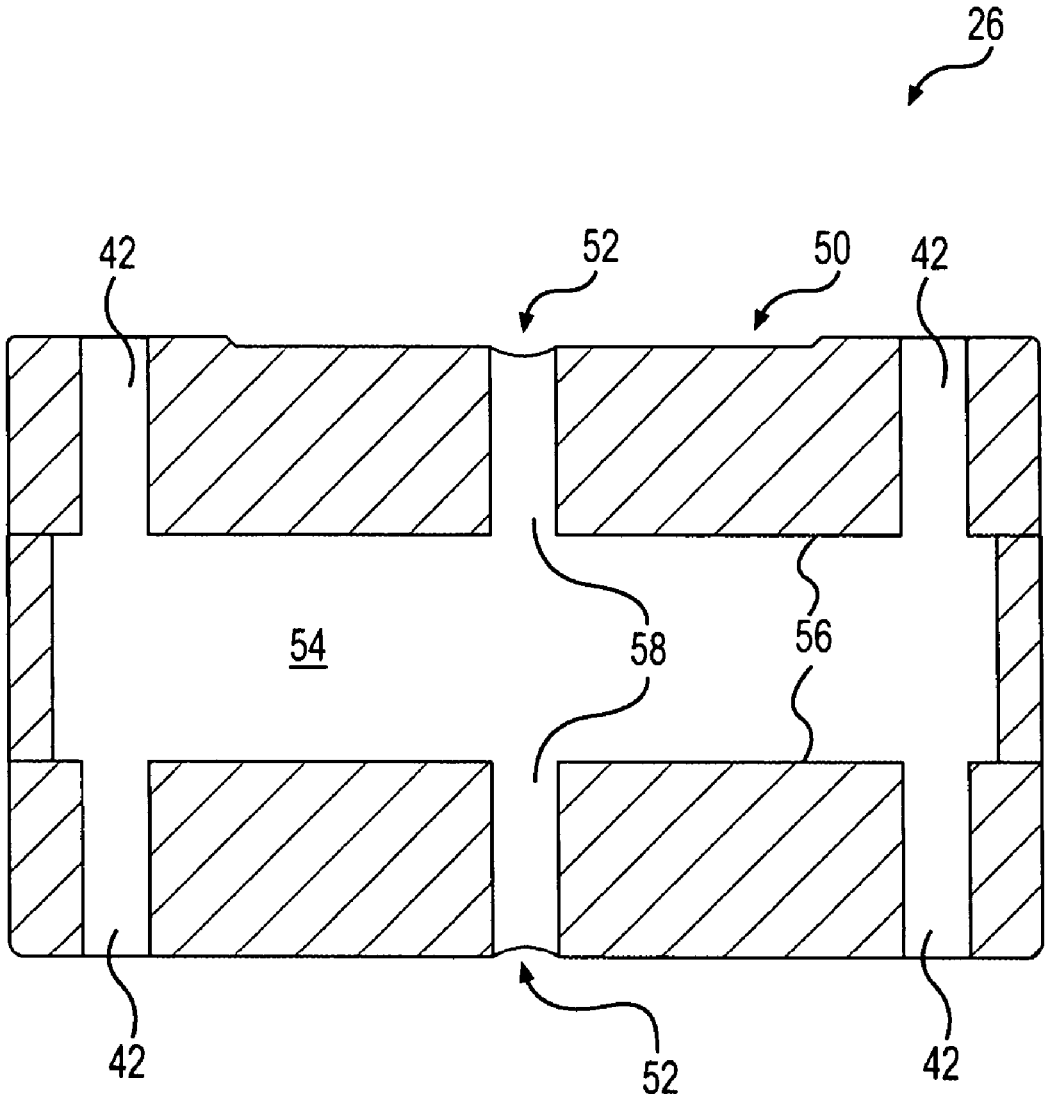
FIG. 6 is a diagrammatic cross-section of an alternative pin for use with the tappet assembly in FIG. 2.

In addition, an alternative embodiment of pin 26 is shown in FIG. 6. As shown in FIG. 6, the central portion of pin 26 may be hollow, including an oil retention reservoir 54 defined by a central bore 56 of pin 26. Reservoir 54 may be in fluid communication with circumferential channel 52 via distribution channels 58. Reservoir 54 may, thus, be configured to retain residual lubrication oil after the engine is shut off, which may provide lubrication during startup. Although reservoir 54 is shown in FIG. 6 to be cylindrical, reservoir 54 could be any suitable shape and/or size and configured to, retain residual lubrication after oil flow through pin 26 has stopped, e.g., after the engine is shut off.

INDUSTRIAL APPLICABILITY

The disclosed tappet assembly may include features that provide the assembly with strength, durability, and efficiency. The disclosed tappet assembly may be used for any application of a tappet having a roller companion to a lobe of a camshaft and a tappet body, which converts the rotational motion of the camshaft into linear motion of the tappet body by rolling on the lobe of the camshaft. For example, the disclosed tappet assembly may be used for actuation of a tappet valve or for actuation of a rocker arm to open intake and/or exhaust valves in an internal combustion engine. The disclosed tappet assembly may also be used for a pumping device (e.g., a piston pump). Such a pumping device may be utilized for pressurizing fuel in a common rail fuel system of an internal combustion engine.

The disclosed tappet assembly 22 is provided with strength and durability by addressing certain structural features of the assembly that may be subject to failure at extreme operating conditions, such as high engine speed and/or loading, as well as low lubrication situations such as cold startup. Some of the features of the disclosed tappet assembly 22 that have been developed to this end are discussed below.

The crown of roller 28 may provide the assembly with, among other attributes, strength and durability. The crown may provide a contact patch between the roller and cam lobe that is spread more evenly across roller 28 than with a perfectly cylindrical roller surface, thus distributing loads more widely across roller 28. Distributing loads more widely across roller 28 reduces stresses in roller 28 by simply reducing the area over which forces are exerted (stress=force/area), which includes preventing stress concentrations that can occur at the ends of rollers without a crown or with a crown that is not configured to spread the contact patch across the roller (e.g., rollers with a significant crown that creates a narrow contact patch in the center portion of the roller). The reductions in stress translate to higher ultimate strength and durability of tappet assembly 22.

In addition, strength and durability may also be provided to tappet assembly 22 by the smaller diameter of roller 28 at ends 34 of roller 28. By providing the ends 34 of roller 28 with a shorter radius, the lever arm with which forces resulting from lateral loading of roller 28 are exerted on inner surfaces 36 of tappet ears 38 is reduced. The reduced lever arm leads to lower forces at the outer edges of the hub diameter for a given lateral loading. This reduction in forces exerted by roller 28 on tappet ears 38 translates to higher strength and durability of tappet assembly 22.

The WCC coating on various parts of tappet assembly 22, provides a reduction of friction between components, particularly in the absence of lubricant, e.g., upon cold startup of an engine. This reduction of friction between components provides tappet assembly 22 with efficiency and wear resistance.

In addition, the use of a bronze alloy, such as those described above, provides pin 26 with strength, while also providing a low friction surface and allowing debris particles to become embedded therein. Allowing particles to become embedded in the surface of pin 26 reduces grinding (and associated wear and/or friction) between outer surface 30 of pin 26 and the inner surface 46 of roller 28.

Although embodiments of the invention have been described, it will be apparent to those skilled in the art that various modifications and variations can be made in the disclosed tappet assembly without departing from the scope of the disclosure. In addition, other embodiments of the disclosed device will be apparent to those skilled in the art from consideration of the specification. It is intended that the specification and examples be considered as exemplary only, with a true scope of the disclosure being indicated by the following claims and their equivalents.

What is claimed is:

1. A tappet assembly for a machine, comprising:

a tappet body;

a pin fixedly mounted in the tappet body; and a substantially cylindrical roller mounted about the pin, the roller having a substantially cylindrical outer surface and two end surfaces, the outer surface having a circumferential dimension and a width dimension, the width dimension being defined by two lateral edges, the two lateral edges being outer edges of the two end surfaces, the two end surfaces of the roller including a hub region proximal to the pin, a width of the roller at the hub region being greater than a width of the roller at the two lateral edges, and a diameter of the roller at the hub region being smaller than a diameter of the roller at the two lateral edges, the roller being configured to provide rolling contact between the outer surface of the roller and a cam lobe;

wherein the outer surface of the roller is crowned.

2. The assembly of claim 1, wherein the roller has a central portion substantially equidistant from the two lateral edges;

wherein the width dimension of the outer surface of the roller is approximately 27 mm; and wherein the crown is about 0.05 mm at its maximum nominal height, providing the roller with a diameter at the central portion that is approximately 0.1 mm larger than at the lateral edges.

3. The assembly of claim 1, wherein the pin is made at least partially from a bronze alloy.

4. The assembly of claim 3, wherein the bronze alloy includes about 1.5-4.5% by weight zinc, about 3.5-4.5% lead, about 3.5-4.5% tin, about 0.01-0.50 phosphorus, about 0.10% max iron, and the remainder copper.

5. A tappet assembly, comprising:

a tappet body;

a pin fixedly mounted in the tappet body; and a substantially cylindrical roller with an outer surface and two end surfaces mounted about the pin and configured to provide rolling contact with a cam lobe, wherein the roller includes two lateral edges defining a width of the roller, the two lateral edges being outer edges of the two end surfaces, the two end surfaces of the roller including a hub region proximal to the pin, a width of the roller at the hub region being greater than a width of the roller at the two lateral edges, and a diameter of the roller at the hub region being smaller than a diameter of the roller at the two lateral edges; and wherein at least a part of the two end surfaces of the roller is coated with a tungsten carbide and carbon coating.

6. The tappet assembly of claim 5, wherein the hub region of each of the two end surfaces of the roller includes a tungsten carbide and carbon coating.

7. The tappet assembly of claim 5, wherein the pin includes lubrication channels to distribute lubrication oil between an outer surface of the pin and an inner surface of the roller, the lubrication channels including a longitudinal channel which extends longitudinally along the outer surface of the pin.

8. The tappet assembly of claim 7, wherein the lubrication channels also include a circumferential channel extending about a circumference of the pin.

9. A tappet assembly, comprising:

a tappet body;

a pin fixedly mounted in the tappet body, the pin including lubrication channels to distribute lubrication oil between an outer surface of the pin and an inner surface of the roller, the lubrication channels including a longitudinal channel which extends longitudinally along the outer surface of the pin and a circumferential channel which extends about a circumference of the pin; and a substantially cylindrical roller mounted about the pin, the roller having a substantially cylindrical outer surface and two opposing end surfaces, the roller being configured to provide rolling contact between the outer surface of the roller and a cam lobe;

wherein at least a part of the two end surfaces of the roller includes a tungsten carbide and carbon coating.

10. The assembly of claim 9, wherein the tappet assembly is configured for use in a machine, wherein the outer surface of the roller has a circumferential dimension and a width dimension, the width dimension being defined by two lateral edges, the two lateral edaes being outer edges of the two end surfaces; and wherein the outer surface of the roller is crowned.

11. The assembly of claim 10, wherein the two end surfaces of the roller includes a hub region proximal to the pin, a width of the roller at the hub region being greater than a width of the roller at the two lateral edges, and a diameter of the roller at the hub region being smaller than a diameter of the roller at the two lateral edges.

12. The assembly of claim 11, wherein the hub region of each of the two end surfaces of the roller includes a tungsten carbide and carbon coating.

13. The assembly of claim 9 wherein the longitudinal channel and the circumferential channel together define a reservoir configured to retain residual lubrication oil after oil flow through the pin has stopped.

14. The assembly of claim 13, wherein the pin further includes an oil retention reservoir defined by a central bore of the pin, wherein the reservoir is in fluid communication with the circumferential channel via distribution channels, and is configured to retain residual lubrication oil after oil flow through the pin has stopped.

15. The assembly of claim 9, wherein additional surfaces of the assembly are coated with the tungsten carbide and carbon coating, including:

an outer surface of the tappet body; and at least one inner surface of the tappet body adjacent at least one of the two end surfaces of the roller.

16. The assembly of claim 9 wherein the pin is made at least partially from a bronze alloy;

wherein the bronze alloy includes about 1.5-4.5% by weight zinc, about 3.5-4.5% lead, about 3.5-4.5% tin, about 0.01-0.50 phosphorus, about 0.10% max iron, and the remainder copper.

17. The assembly of claim 10, wherein the roller has a central portion substantially equidistant from the two lateral edges;

wherein the width dimension of the outer surface of the roller is approximately 27 mm; and wherein the crown of the outer surface of the roller includes a diameter at the central portion of the outer surface that is approximately 0.1 mm larger than that at the lateral edges.

18. The assembly of claim 17, wherein the pin is fixed within the tappet body by an interference fit.

19. The assembly of claim 18, wherein the machine is a pumping device.

20. The assembly of claim 19, wherein the pumping device is a common rail fuel pump.

* * * * *